United States Patent [19]

Dent

[11] 3,934,779

[45] Jan. 27, 1976

[54] FASTENER DRIVING TOOL

[76] Inventor: Gilbert Dent, 103-01 118th St., Richmond Hill, N.Y. 11419

[22] Filed: Oct. 31, 1974

[21] Appl. No.: 519,670

[52] U.S. Cl. ..... 227/147; 227/149

[51] Int. Cl.[2] ..... B25C 1/04

[58] Field of Search ..... 227/140, 147, 149; 145/46

[56] References Cited

UNITED STATES PATENTS

| | | | |
|---|---|---|---|
| 1,500,253 | 7/1924 | Miller | 227/147 X |
| 1,867,928 | 7/1932 | Smith | 145/46 |
| 2,871,480 | 2/1959 | Pezza et al. | 145/46 |
| 3,117,378 | 1/1964 | Bowen | 227/147 X |
| 3,490,677 | 1/1970 | Pezza | 227/147 |

*Primary Examiner*—Granville Y. Custer, Jr.

[57] ABSTRACT

An improved fastener driving tool having particular utility at locations that are otherwise inaccessible is disclosed. The fastener driving tool of this invention includes an elongated cylinder having one closed end. A ram is slidably mounted in the cylinder so that one end of the ram bears against the inside surface of the closed end of the cylinder. An axially displaceable rod is mounted on the outside surface of the cylinder and includes a clip that is adapted to hold the head of the nail against the outside surface of the closed end of the cylinder. With the nail so positioned the tool may be inserted behind a wall, for example through a pre-existing window opening, so that a header may be secured to a stud. By using the tool of the present invention, it is not necessary to remove any plaster or wallboard in order to expose the header and studs that are to be nailed. The ram is moved axially in two opposite directions within the cylinder until the nail is sufficiently started. Then the rod may be depressed in order to free the clip from the nailhead. The tool can then be removed and the ram used alone for fully setting the nail. Alternatively, the cylinder may have two open ends so that the ram impacts directly on the head of the fastener.

7 Claims, 4 Drawing Figures

FASTENER DRIVING TOOL

BACKGROUND OF THE INVENTION

1. Field of the Invention

This invention relates generally to fastener driving tools and more particularly to a nail driving tool that may be used in remote, inaccessible locations without any unnecessary alteration to an existing wall.

2. Description of the Prior Art

It has long been a problem for carpenters or the like to satisfactorily join two members by means of nails when the two members are at an inaccessible location. One example of just such a situation is the nailing of a header to a stud after the wall has been plastered or after the wallboard is in place. Prior to the present invention it was frequently necessary to enlarge the opening such as a window opening in order to join the header to the stud. This of course necessitated some additional expense and frequently resulted in an unsightly work product. Merely using an elongated rod to drive the nail is unsatisfactory since frequently the juncture of the header and the stud is not visible. Moreover no means has heretofor been provided for releasably holding the nail prior to its being started.

SUMMARY OF THE INVENTION

In its broadest aspect the present invention provides an improved fastener driving tool that is particularly useful in remote and otherwise inaccessible locations. The present invention includes an elongated cylinder which in one embodiment has an open end and a closed end and which, in another embodiment, has two open ends. A ram that is slidably mounted in the cylinder abuts either the inside surface of the closed end thereof or the head of the fastener. A rod, supported on the cylinder by means of radially oriented projections carries a clip at the lower end thereof with the clip being in opposition to the closed end of the cylinder. The clip in one embodiment of the invention is provided with a U-shaped end so that a nail may be supported thereon. After the nail has been started by axially displacing the ram so as to successively bear against the inside surface of the closed end of the cylinder, the rod can be depressed against the action of a compression spring so as to free the clip from underneath the nail head. The cylinder, the ram, the rod and clip may then be removed and the ram can be used for completely setting the nail.

Accordingly, it is a primary object of the present invention to provide an improved fastener driving tool that is particularly used in remote, inaccessible locations.

Another object of the present invention is to provide an improved fastener driving tool, such as described above, that is of low cost and which is readily useable without any special skill.

A particular object of the present invention is to provide an improved fastener driving tool, such as described above, that can releasably hold a headed nail while it is being started at a remote and inaccessible location and which includes means for completely setting the nail.

These and other objects, features and advantages of the invention will, in part, be pointed out with particularity and will, in part, become obvious from the following more detailed description of the invention, taken in conjunction with the accompanying drawing, which forms an integral part thereof.

Brief Description of the Drawing

In the various figures of the drawings, like reference characters designate like parts. In the drawing.

DESCRIPTION OF THE PREFERRED EMBODIMENT

Figure 1:
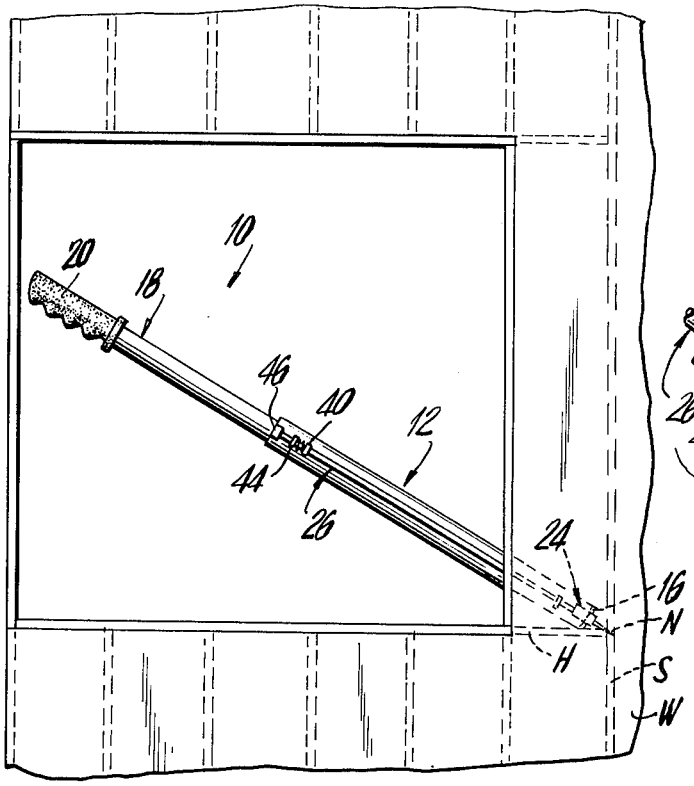
FIG. 1 is a fragmentary elevational view illustrating the method of using the present invention.

Referring now to the drawing, and in particular to FIG. 1, there is shown an improved fastener driving tool 10 comprising the present invention positioned at least partially behind a wall W. It will be readily appreciated that, without the present invention, it would be very difficult to nail the header H to the stud S unless a portion of the wall W was removed. However, because the tool comprising this invention has not heretofore been available, it has been the practice to break or otherwise open up the wall at least in the vicinity of the juncture of the header H and the stud S so that these two structural members may be fastened to each other. Obviously breaking open the wall entails some additional expense and requires that the wall be refinished. Frequently an entire wall must be repainted or even an entire room must be repainted because of changes in the color of the wall that make a perfect match impossible.

Figure 2:
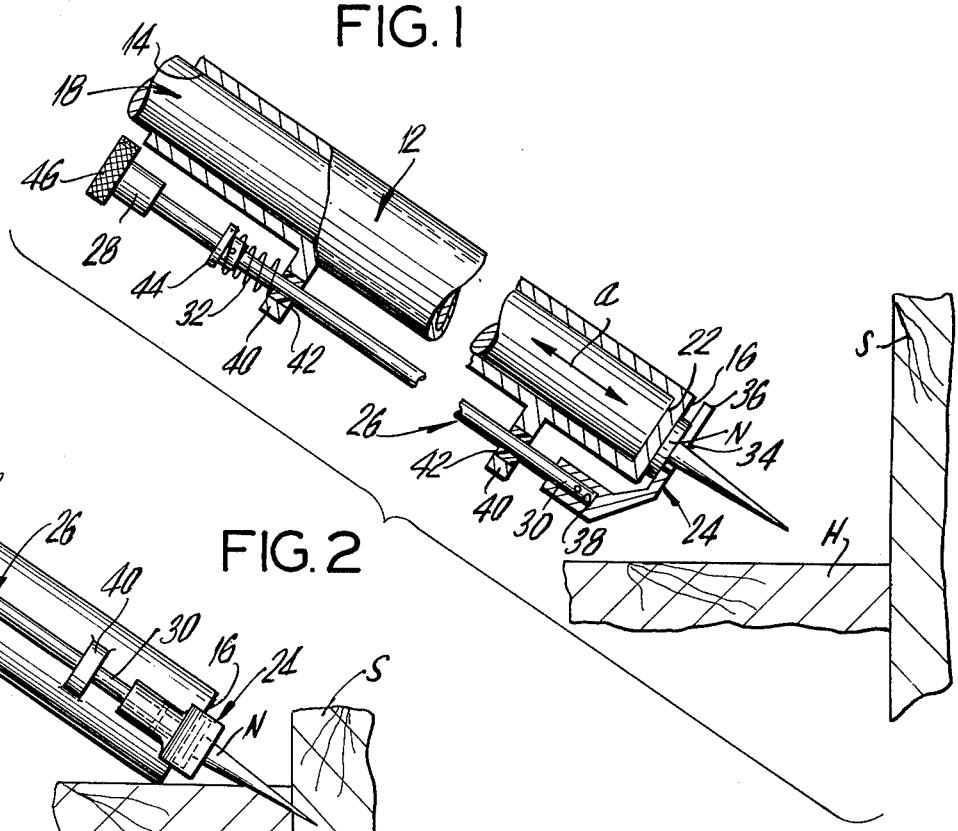
FIG. 2 is an exploded fragmentary view partially in section and partially in elevation illustrating and positioning of the present invention prior to the starting of the nail.

The tool 10 comprising the present invention is shown best in FIG. 2. It will be seen therein that the tool 10 comprises a tubular cylinder 12 having an open, upper end 14 and a closed, lower end 16. Within the tube there is positioned an elongated ram 18 having an upper end 20 and a lower end 22. As shown for example in FIG. 1 it is convenient if a hand gripping portion is formed at the upper end 20 of the ram 18.

A clip, generally designated by the reference character 24, is positioned adjacent the lower end 16 of the cylinder 12 and the lower end 22 of the ram 18 by means of an elongated rod that is generally designated by the reference character 26. The rod 26 has an upper end 28 and a lower end 30 that is secured to the clip 24 in any convenient manner such as by a transverse pin, for example. A compression spring 32 normally biases the clip 24 in a direction towards the lower end 16 of the cylinder 12.

While a specific embodiment is illustrated, it should be clearly understood that the scope of the present invention is not limited necessarily to that precise structure. For example, the clip 24 may be made in a generally L-shape with one portion being defined by a pair of legs 34 that define a central slot 36. The other portion of the L-shaped clip 24 may be in a tubular form having a socket 38 for receiving the lower end 30 of the rod 26.

Additionally, the cylinder 12 may be provided with two axially spaced apart, radially extending projections 40 each having a bushing 42 therein for slidably receiving the rod 26. A collar 44 may be secured to the rod 26 intermediate the end 28 thereof and the upper projection 40 so that the spring 32 extends between the collar 44 and the upper projection 40 in order to bias the rod 26 in a normally upwards position. For ease of manipulation the upper end 28 of the rod 26 may be formed with an integral knob 46.

In order to use the tool 10 comprising this invention the head of a nail N is positioned betweeen the confronting surfaces of the lower end 16 of the cylinder 12 and the legs 34 of the clip 24. The shank of the nail N is positioned in the slot 36. Because the spring 32 normally biases both the clip 24 and the rod 26 in an upward direction as viewed in FIG. 2, the nail N will be securely held in place. The point of the nail is then brought into engagement with the top surface of the header H adjacent the stud S. With one of the users hands gripping the cylinder 12 the other hand is used to grip the ram 18 and to drive the ram up and down in the direction shown by the arrow A in FIG. 2. This will cause the lower end 22 of the ram 18 to exert a force on the lower end 16 of the cylinder 12. The force exerted will be transmitted through the lower surface 16 of the cylinder 12 and to the head of the nail N to thereby drive the nail N through the corner of the header H and at least partially into the stud S as shown in FIG. 3.

In order to remove the tool 10 after the nail N has been started, such as described above and shown in FIG. 3, the rod 26 is axially depressed downward as viewed in FIG. 2, for example. This action spaces the clip 24 from the lower end 16 of the cylinder 12 and the tool may then be rotated until there is clearance that is sufficient for permitting the removal thereof while leaving the nail N in place.

Figure 3:
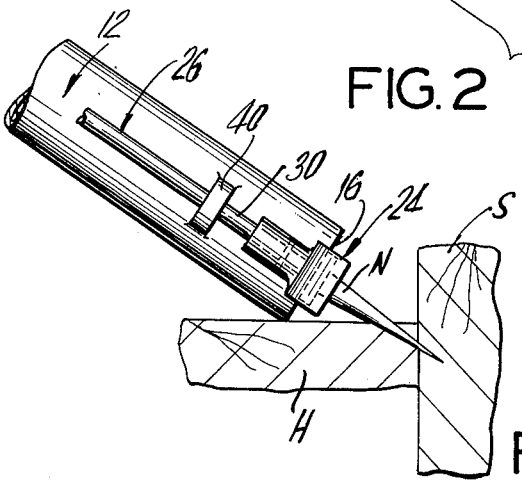
FIG. 3 is a fragmentary elevational view of the present invention illustrating the nail after it has been started and prior to its being set, the tool having been rotated 90° about the longitudinal axis thereof.

It should be appreciated that where the working area is extremely cramped, the tool 10 may be oriented such as shown in FIG. 3. That is, the tool 10 is rotated 90° about its own longitudinal axis from a position shown in FIG. 2. The same operating procedures outlined above of course apply equally well.

Once the nail N has been started, such as shown in FIG. 3, the tool may be removed and the ram 18 alone may be used for completely setting the nail N. That is, the lower end of the ram 18 is positioned against the head N of the nail and a hammer is used to apply a driving force to the upper end 20 of the ram 18.

Figure 4:
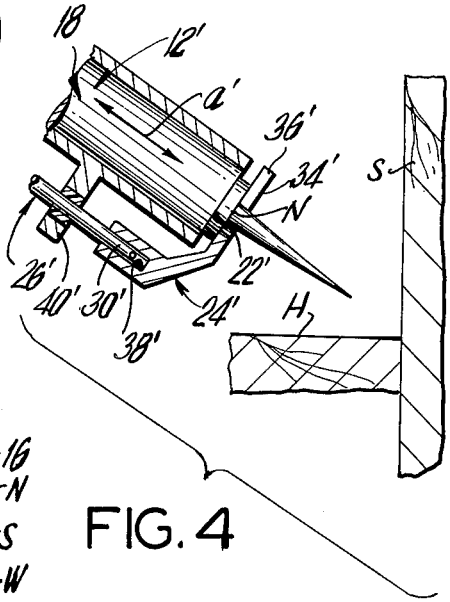
FIG. 4 is a fragmentary view, similar to FIG. 2, illustrating an alternative embodiment of this invention.

Alternatively, as shown in FIG. 4 the end wall 16 may be dispensed with so that the ram 18 impacts directly on the head of the nail N. For ease of description, primed reference characters are used in FIG. 4 to illustrate the similarity of structural elements with those shown in the first embodiment. That is, the members designated by the reference characters 12′, 22′, 26′, 30′, 36′, 38′ and *a′* shown in FIG. 4 are structurally the same as their counterpart reference characters 12, 22, 26, 30, 36, 38 and *a*, respectively, in FIGS. 1, 2, and 3. To facilitate the holding of the nail N in the second embodiment, in the absence of the wall 16, the clip 24′, or at least the legs 34′ thereof may be made of a magnetic material that is capable of releasably holding the nail N.

There has been disclosed heretofore, the best embodiment of the invention presently contemplated. However, it is to be understood that various changes and modifications may be made thereto without departing from the spirit of the invention.

What I claim as new and desire to secure by United States Letters Patent is:

1. A fastener driving tool for use at otherwise inaccesible locations, said fastener driving tool comprising:
   a. a cylinder having a first open end and a second end;
   b. an elongated ram slidably mounted in said first open end of said cylinder, said ram including a first end positioned outwardly of said first end of said cylinder and a second end adjacent said second end of said cylinder;
   c. a clip for releasably holding the head of a fastener proximate said second end of said cylinder;
   d. an elongated, axially displaceable rod mounted on and positioned substantially parallel to the longitudinal axis of said cylinder, said rod having a first end positioned proximate said first end of said cylinder and a second end coupled to said clip; and
   e. spring means for normally biasing said rod and said clip to a fastener holding position.

2. The fastener driving tool according to claim 1 wherein said clip is generally L-shaped and has a U-shaped first end for receiving the shank of the fastener whereby the head of the fastener is positioned between said clip and said second end of said cylinder, said clip further including a second end that is coupled to said second end of said rod.

3. The fastener driving tool according to claim 1 wherein said rod is rotatable about its own longitudinal axis.

4. The fastener driving tool according to claim 1 wherein said cylinder includes axially spaced apart, radially extending projections for supporting said rod and said spring means is a compression spring having two opposed ends that extend between and bear against a portion of said rod and one of said projections.

5. The fastener driving tool according to claim 4 wherein said projections each include a bushing for slidably supporting said rod.

6. The fastener driving tool according to claim 1 wherein at least the portion of said clip that holds the head of the fastener is made of a magnetic material.

7. The fastener driving tool according to claim 1 wherein said second end of said cylinder is closed whereby the head of the fastener is held against the outside surface of said closed end by said clip so that said ram impacts against the inside surface of said closed end.

* * * * *